US010370743B2

(12) United States Patent
Kobayashi et al.

(10) Patent No.: US 10,370,743 B2
(45) Date of Patent: Aug. 6, 2019

(54) ALUMINUM ALLOY WIRE, ALUMINUM ALLOY TWISTED WIRE, COVERED WIRE, AND WIRING HARNESS

(71) Applicants: AUTONETWORKS TECHNOLOGIES, LTD., Yokkaichi-shi, Mie (JP); SUMITOMO WIRING SYSTEMS, LTD., Yokkaichi-shi (JP); SUMITOMO ELECTRIC INDUSTRIES, LTD., Osaka-shi, Osaka (JP)

(72) Inventors: Hiroyuki Kobayashi, Yokkaichi (JP); Kinji Taguchi, Yokkaichi (JP); Yasuyuki Ootsuka, Yokkaichi (JP); Tetsuya Kuwabara, Osaka (JP); Misato Kusakari, Osaka (JP)

(73) Assignees: Autonetworks Technologies, Ltd., Yokkaichi-shi, Mie (JP); Sumitomo Wiring Systems, Ltd., Yokkaichi-shi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 0 days.

(21) Appl. No.: 15/735,536

(22) PCT Filed: May 23, 2016

(86) PCT No.: PCT/JP2016/065116
§ 371 (c)(1),
(2) Date: Dec. 11, 2017

(87) PCT Pub. No.: WO2016/199564
PCT Pub. Date: Dec. 15, 2016

(65) Prior Publication Data

US 2018/0171439 A1 Jun. 21, 2018

(30) Foreign Application Priority Data

Jun. 12, 2015 (JP) ..... 2015-118885

(51) Int. Cl.
*H01B 1/02* (2006.01)
*C22C 21/08* (2006.01)
*C22C 21/00* (2006.01)
*H01B 5/02* (2006.01)
(Continued)

(52) U.S. Cl.
CPC ..... *C22C 21/08* (2013.01); *C22C 21/00* (2013.01); *C22F 1/05* (2013.01); *H01B 1/02* (2013.01);
(Continued)

(58) Field of Classification Search
CPC ..... H01B 1/023
(Continued)

(56) References Cited

U.S. PATENT DOCUMENTS 4,216,031 A * 8/1980 Chia ..... C22C 21/00 148/437
5,223,050 A * 6/1993 Bryant ..... C22F 1/05 148/415
(Continued)

FOREIGN PATENT DOCUMENTS

CN 103298963 A 9/2013
JP 2005-307223 * 11/2005
(Continued)

OTHER PUBLICATIONS

Korean Office Action for Application No. 10-2017-7034389 dated Mar. 13, 2018; 3 pages.
(Continued)

*Primary Examiner* — Chau N Nguyen
(74) *Attorney, Agent, or Firm* — Reising Ethington, P.C.

(57) ABSTRACT

An aluminum alloy wire, an aluminum alloy twisted wire, a covered wire, and a wiring harness, which are excellent in impact strength when a terminal fitting is connected. An aluminum alloy wire contains 0.03% or more and 1.5% or less by mass of Mg, 0.02% or more and 2.0% or less by mass
(Continued)

of Si, and 0.1% or more and 0.6% or less by mass of Fe, with the balance consisting of Al and impurities; the wire containing acicular-shaped $Mg_2Si$ precipitates of 2.0 to 6.0 in aspect ratio. Further, provided are an aluminum alloy twisted wire containing a plurality of the aluminum alloy wires; a covered wire containing a conductor containing the aluminum alloy wire, and an insulation coating covering the outer circumference of the conductor; and a wiring harness containing a terminal fitting attached to the conductor of the covered wire.

16 Claims, 2 Drawing Sheets

(51) Int. Cl.

| | |
|---|---|
| ***H01B 7/00*** | (2006.01) |
| ***C22F 1/05*** | (2006.01) |
| *C22F 1/00* | (2006.01) |
| *C22F 1/04* | (2006.01) |
| *H01B 7/02* | (2006.01) |

(52) U.S. Cl.
CPC ..... *H01B 1/023* (2013.01); *H01B 5/02* (2013.01); *H01B 7/00* (2013.01); *C22F 1/00* (2013.01); *C22F 1/04* (2013.01); *H01B 7/02* (2013.01)

(58) Field of Classification Search
USPC ..... 174/94 R; 148/415
See application file for complete search history.

(56) References Cited

U.S. PATENT DOCUMENTS

| | | | | |
|---|---|---|---|---|
| 5,532,069 | A * | 7/1996 | Masumoto | C22C 1/0491 419/28 |
| 9,324,471 | B2 * | 4/2016 | Sekiya | C22C 21/02 |
| 9,580,784 | B2 * | 2/2017 | Sekiya | C22C 21/00 |
| 2012/0312427 | A1 * | 12/2012 | Iwamura | C22C 21/12 148/417 |
| 2013/0264115 | A1 | 10/2013 | Kobayashi et al. | |
| 2015/0213913 | A1 | 6/2015 | Yoshida et al. | |
| 2015/0279499 | A1 | 10/2015 | Sekiya et al. | |

FOREIGN PATENT DOCUMENTS

| | | | |
|---|---|---|---|
| JP | 5607853 | B1 | 10/2014 |
| JP | 5607855 | B | 10/2014 |
| WO | WO2012141041 | A | 10/2012 |
| WO | WO2014/155817 | A | 10/2014 |

OTHER PUBLICATIONS

English Translation of KoreanOffice Action for Application No. 10-2017-7034389 dated Mar. 13, 2018; 4 pages.
Korean Office Action for Application No. 9-5-2017-089777103 dated Dec. 21, 2017; 5 pages.
Translation of Korean Office Action for Application No. 9-5-2017-089777103 dated Dec. 21, 2017; 5 pages.
International Search Report for Application No. PCT/JP2016/065116 dated Aug. 9, 2016; 5 pages.
Chinese Office Action for Application No. 201680034009.1 dated Jun. 20, 2018; 8 pages.
English Translation of Chinese Office Action for Application No. 201680034009.1 dated Jun. 20, 2018; 9 pages.
Decision of Rejection from Chinese Patent Office for Application No. 201680034009.1 dated Feb. 25, 2019; 5 pages.
English Translation of Decision of Rejection from Chinese Patent Office for Application No. 201680034009.1 dated Feb. 25, 2019; 7 pages.
Chinese Office Action for Application No. 201680034009.1 dated Nov. 6, 2018; 6 pages.
English Translation of Chinese Office Action for Application No. 201680034009.1 dated Nov. 6, 2018; 7 pages.

* cited by examiner

ALUMINUM ALLOY WIRE, ALUMINUM ALLOY TWISTED WIRE, COVERED WIRE, AND WIRING HARNESS

CROSS REFERENCE TO RELATED APPLICATIONS

This application claims the priority of Japanese patent application JP2015-118885 filed on Jun. 12, 2015, the entire contents of which are incorporated herein.

TECHNICAL FIELD

The present application relates to: an aluminum alloy wire and an aluminum alloy twisted wire suitable as conductors of electric wires; and a covered wire and a wiring harness using them as conductors.

BACKGROUND ART

Use of an aluminum alloy wire as a conductor of an electric wire such as an electric wire for an automobile has been proposed. An example of which is disclosed in JP5607853B.

SUMMARY

A conventional aluminum alloy wire, however, has not had adequate strength when it is used as an extra-fine wire having a diameter of 0.5 mm or less for example. Further, impact strength has been insufficient when a terminal fitting is connected to the wire.

A problem to be solved by the present application is to provide an aluminum alloy wire, an aluminum alloy twisted wire, a covered wire, and a wiring harness, which are excellent in impact strength when terminal fittings are connected thereto.

The aluminum alloy wire according to the present application is, in order to solve the above problem, characterized in that the aluminum alloy wire contains
0.03% or more and 1.5% or less by mass of Mg, 0.02% or more and 2.0% or less by mass of Si and 0.1% or more and 0.6% or less by mass of Fe, with the balance consisting of Al and impurities, the wire containing acicular-shaped $Mg_2Si$ precipitates of 2.0 to 6.0 in aspect ratio.

Further, the aluminum alloy wire according to the present application preferably contains 0.01% or more by mass of Zr. Further, the aluminum alloy wire according to the present application preferably contains 0.08% or less by mass of Ti. Further, the aluminum alloy wire according to the present application preferably contains 0.016% or less by mass of B.

The aluminum alloy wire according to the present application preferably has a dislocation density of $5.0\times10^9$ $cm^{-2}$ or less. The number of the $Mg_2Si$ precipitates having grain diameters of 5 to 50 nm is preferably 100 or more in an area of 350 nm×425 nm on a cross section in a radial direction of the wire. The $Mg_2Si$ precipitates preferably have a length less than 40 nm. The $Mg_2Si$ precipitates are preferably oriented in an axial direction of the wire.

The aluminum alloy wire according to the present application preferably has a tensile strength of 150 MPa or higher, an elongation of 5% or higher, and an electric conductivity of 40% IACS or higher. The aluminum alloy wire according to the present application preferably has a diameter of 0.5 mm or less.

The aluminum alloy twisted wire according to the present application is characterized in that the wire contains a plurality of the aluminum alloy wires according to the present invention, twisted together.

The aluminum alloy twisted wire according to the present application may be compressed in a radial direction.

The covered wire according to the present application is characterized in that the wire contains a conductor with the aluminum alloy wire according to the present application, and an insulation coating covering the outer circumference of the conductor.

Further, the wiring harness according to the present application is characterized in that the harness contains the covered wire according to the present application and a terminal fitting attached to the conductor of the covered wire.

The aluminum alloy wire according to the present application has high electric conductivity, is excellent in strength and elongation, and is excellent in impact strength by strength increase caused by work hardening when a terminal fitting is connected to the wire because: the aluminum alloy wire contains 0.03% or more and 1.5% or less by mass of Mg, 0.02% or more and 2.0% or less by mass of Si, and 0.1% or more and 0.6% or less by mass of Fe, with the balance consisting of Al and impurities, the wire containing acicular-shaped $Mg_2Si$ precipitates of 2.0 to 6.0 in aspect ratio.

In this case, elongation increases further when the wire contains 0.01% or more by mass of Zr. Further, a crystal structure becomes finer and elongation increases when the wire contains 0.08% or less by mass of Ti. The effect of the fining of a crystal structure improves further when the aluminum alloy wire contains 0.016% or less by mass of B together with Ti.

Further, when a dislocation density is $5.0\times10^9$ $cm^{-2}$ or less, work hardening occurs excellently and impact strength increases when a terminal fitting is connected to the wire. When the number of $Mg_2Si$ precipitates is not less than a prescribed number, strength increase by precipitation strengthening is excellent. Furthermore, when the $Mg_2Si$ precipitates have lengths less than 40 nm, both high strength and high elongation can be obtained and impact strength is excellent. Moreover, when the $Mg_2Si$ precipitates are oriented in an axial direction of the wire, stable impact strength can be obtained.

Further, when the wire has a tensile strength of 150 MPa or higher, an elongation of 5% or higher, and an electric conductivity of 40% IACS or higher, electric conductivity is high and strength and elongation are excellent.

Further, each of an aluminum alloy twisted wire, a covered wire, and a wiring harness according to the present application has high electric conductivity, is excellent in strength and elongation, and is excellent in impact strength by strength increase caused by work hardening when a terminal fitting is connected.

DESCRIPTION OF EMBODIMENTS

Figure 1A:
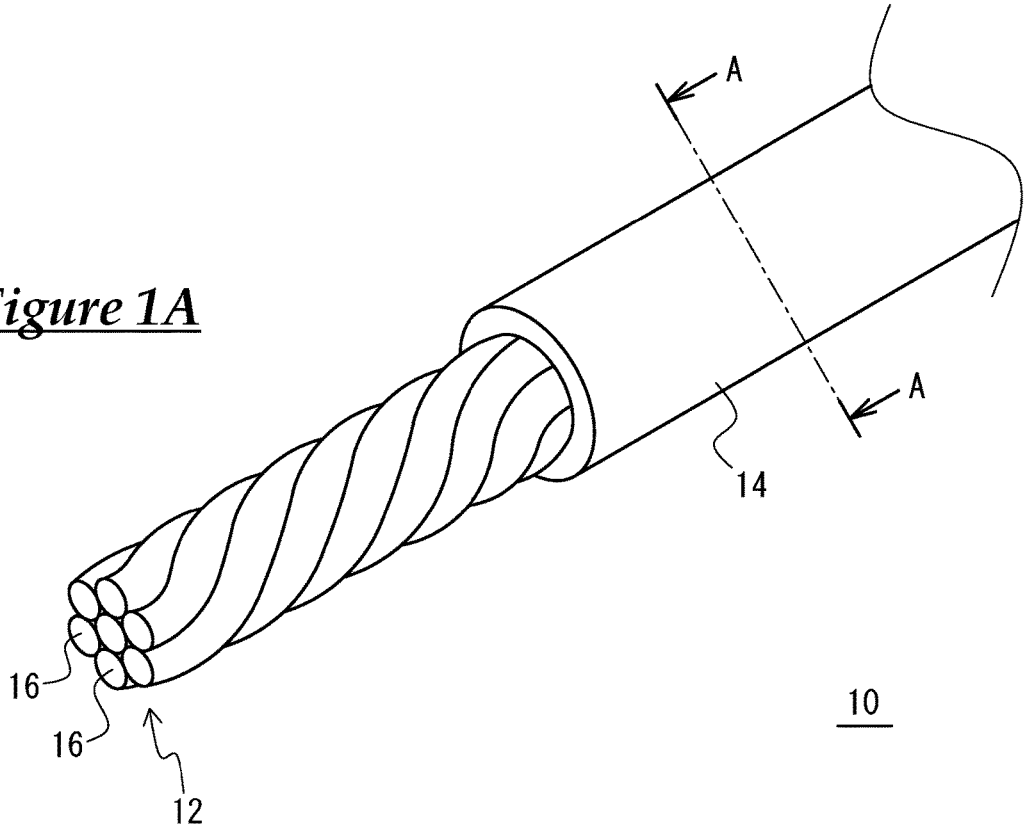
FIG. 1 shows a schematic diagram (a) of a covered wire according to an embodiment of the present application and a sectional view (b) taken on line A-A.

An embodiment according to the present application is hereunder explained in detail.

In the aluminum alloy wire according to the present application, an aluminum alloy is: an Al—Mg—Si type alloy essentially containing Mg and Si as additive elements. This is a so-called 6000 series aluminum alloy and an aluminum alloy of a precipitation strengthening type that has $Mg_2Si$ as precipitates. In the aluminum alloy wire according to the present application, Mg, Si, and Fe are essential additive components and Zr, Ti, and B are optional additive components.

Mg contributes to strength increase by existing in Al in the state of a solid solution or precipitates. Mg is an element having a high effect in increasing strength and can effectively increase strength of the wire by age hardening in particular by being contained in a specific amount range simultaneously with Si. A content of Mg is 0.03% or more by mass from the viewpoint of increasing the strength of the wire. The content is preferably 0.2% or more by mass and more preferably 0.3% or more by mass. On the other hand, the content of Mg is 1.5% or less by mass from the viewpoint of inhibiting electric conductivity and elongation of the wire from lowering by the addition of Mg. The content is preferably 0.9% or less by mass and more preferably 0.8% or less by mass.

Si contributes to strength increase by existing in Al in the state of a solid solution or precipitates. Si can effectively increase strength by age hardening by being contained in a specific amount range simultaneously with Mg. A content of Si is 0.02% or more by mass from the viewpoint of increasing the strength of the wire. The content is preferably 0.1% or more by mass and more preferably 0.3% or more by mass. On the other hand, the content of Si is 2.0% or less by mass from the viewpoint of inhibiting electric conductivity and elongation of the wire from lowering by the addition of Si. The content is preferably 1.5% or less by mass and more preferably 0.8% or less by mass.

Fe fines the crystal of an Al alloy and contributes to the increase of elongation. Further, Fe is effective also for increasing strength. A content of Fe is 0.1% or more by mass from the viewpoint of increasing elongation and strength of the wire. The content is preferably 0.15% or more by mass. On the other hand, the content of Fe is 0.6% or less by mass from the viewpoint of inhibiting electric conductivity from lowering. The content is preferably 0.3% or less by mass.

Zr fines the crystal of an Al alloy and contributes to the increase of elongation. Zr has a high effect in fining and increase of elongation and can increase elongation even when very small amount is contained in the alloy. Further, Zr suppresses growth of crystal grains even when heat is applied during manufacturing or use and makes the crystal grains easy to maintain in a fine state. That is, Zr contributes also to improvement of high-temperature characteristics such as high-temperature strength and thermal resistance. A content of Zr is preferably 0.01% or more by mass from the viewpoint of being excellent in the effect of increasing elongation or the like. The content is more preferably 0.02% or more by mass. On the other hand, the content of Zr is preferably 0.4% or less by mass from the viewpoints of inhibiting electric conductivity from lowering and suppressing generation of cracks during casting. The content is more preferably 0.2% or less by mass and even more preferably 0.1% or less by mass.

Ti has the effect of the fining of the crystal structure of an Al alloy during casting. A content of Ti is preferably 0.005% or more by mass from the viewpoint of the fining effect. On the other hand, the content of Ti is preferably 0.08% or less by mass from the viewpoint of inhibiting electric conductivity from lowering. The content is more preferably 0.05% or less by mass and even more preferably 0.02% or less by mass.

B has the effect of the fining of the crystal structure of an Al alloy during casting. B may be used not together with Ti but independently. The fining effect is higher when B is used together with Ti than when B is used independently. A content of B is preferably 0.0005% or more by mass from the viewpoint of the fining effect. The content is more preferably 0.001% or more by mass. On the other hand, the content of B is preferably 0.016% or less by mass from the viewpoint of inhibiting electric conductivity from lowering. The content is more preferably 0.01% or less by mass.

In an aluminum alloy wire according to the present application, an $Mg_2Si$ precipitate has an acicular shape. The aspect ratio is in the range of 2.0 to 6.0. As a result, work hardening is excellent, strength of the wire is increased by the work hardening when a terminal fitting is connected to the wire, and impact strength is excellent. When a terminal fitting is connected, an aluminum alloy wire is compressed by crimping and the strength is lowered by a sectional area loss. The decrease of strength is compensated by the work hardening during the compression, and thus the impact strength increases. In an aluminum alloy wire according to the present application, for example, by setting a heat treatment condition minutely, $Mg_2Si$ precipitates can have an acicular shape and the aspect ratio can be in the specific range.

The aspect ratio can be determined by measuring the length and width of an $Mg_2Si$ precipitate and calculating the ratio therebetween. The length of an $Mg_2Si$ precipitate is defined as the maximum length (long axis) of a particle of the $Mg_2Si$ precipitate and the width of an $Mg_2Si$ precipitate is defined as the maximum length (short axis) in a direction perpendicular to the long axis.

In the aluminum alloy wire according to the present application, the long axis of an $Mg_2Si$ precipitate in a crystal grain is preferably less than 40 nm, more preferably 35 nm or less, and even more preferably 30 nm or less. When the long axis of an $Mg_2Si$ precipitate is less than 40 nm, strength increases by a pinning effect in a crystal grain, and dislocations hardly accumulate, hence elongation also increases. The long axis of an $Mg_2Si$ precipitate, however, is preferably 2 nm or more, more preferably 3 nm or more, and even more preferably 5 nm or more. When the long axis of an $Mg_2Si$ precipitate is 2 nm or more, there is less risk of strength decrease caused by break (fracture or the like) of the $Mg_2Si$ precipitates during the deformation of an aluminum alloy wire. In an aluminum alloy wire according to the present application, the length of the long axis of an $Mg_2Si$ precipitate can be controlled in the specific range by setting a heat treatment condition minutely for example.

In the aluminum alloy wire according to the present application, $Mg_2Si$ precipitates contribute to strength increase. From the viewpoints of strength increase, the number of the $Mg_2Si$ precipitates is preferably 100 or more in an area of 350 nm×425 nm on a cross section in a radial direction of the wire. The number is more preferably 150 or more. When the number of the precipitates increases in contrast, strength increases but elongation lowers and work hardening hardly occurs. From those viewpoints, the number of the $Mg_2Si$ precipitates is preferably 1,000 or fewer in an area of 350 nm×425 nm on a cross section in a radial direction of the wire. The number is more preferably 800 or fewer. The number of the $Mg_2Si$ precipitates can be controlled in a specific range by the amounts of the additive elements and manufacturing conditions (a softening condition, an aging condition, a process sequence, and others).

The length, width, aspect ratio, and number (number of pieces) of $Mg_2Si$ precipitates are measured for $Mg_2Si$ precipitates 5 to 50 nm in grain diameter. A grain diameter is represented by the length of a long axis. Those measurements can be carried out by observing an aluminum alloy wire in an area of 350 nm×425 nm on a cross section in a radial direction with a transmission electron microscope (TEM). The TEM observation is applied to at least five observation fields where $Mg_2Si$ precipitates can be recognized in an identical specimen. The length, width, and aspect ratio of $Mg_2Si$ precipitates are obtained by measuring those values of all observed grains 5 to 50 nm in grain diameter of the $Mg_2Si$ precipitates and averaging the values, respectively. The number (number of pieces) of $Mg_2Si$ precipitates is represented by an average value in observation at least five observation fields. Here, an $Mg_2Si$ precipitate exceeding 50 nm in grain diameter is coarse and does not contribute to strength. An $Mg_2Si$ precipitate exceeding 50 nm in grain diameter can be measured by observation in an observation field of 16 μm×6.8 μm with a TEM. The TEM observation can be applied to at least five observation fields where coarse $Mg_2Si$ precipitates can be recognized in an identical specimen. The number of coarse grains of $Mg_2Si$ precipitates exceeding 50 nm in grain diameter is preferably 50 or less.

In an aluminum alloy wire according to the present application, an $Mg_2Si$ precipitate is oriented preferably in an axial direction of the aluminum alloy wire. As a result, strength of the wire increases.

In an aluminum alloy wire according to the present application, dislocations are preferably few in the aluminum alloy. When dislocations are few, work hardening is excellent. A dislocation density is preferably $5.0\times10^9$ $cm^{-2}$ or less and more preferably $1.0\times10^9$ $cm^{-2}$ or less. Dislocations can be reduced by heat treatment. A dislocation density can be obtained by observing a thin film produced from an aluminum alloy wire with a transmission electron microscope (TEM) and calculating through a Ham formula.

The aluminum alloy wire according to the present application is excellent in electric conductivity, strength, and elongation and has tensile strength (at room temperature) of 150 MPa or higher, electric conductivity of 40% IACS or higher, and elongation (at room temperature) of 5% or higher. Higher tensile strength and higher electric conductivity are preferable, but when balance thereof to the with elongation is taken into consideration, the upper limit of the tensile strength (at room temperature) is about 400 MPa and the upper limit of the electric conductivity is about 60% IACS. Tensile strength and elongation can be measured with a general-purpose tensile tester in accordance with JIS Z2241 (Method of Tensile Test for Metallic Materials, 1998). Elongation means an elongation at break of the wire. Electric conductivity (% IACS) can be measured by a bridge method. The tensile strength, elongation, and electric conductivity can be controlled in the specific ranges by the type and the amount of the additive elements and manufacturing conditions (a softening condition, an aging condition, a process sequence, and others).

The aluminum alloy wire according to the present application can be an extra-fine wire 0.5 mm or less in diameter. When it is used as a conductor of an electric wire for an automobile for example, the wire diameter can be 0.1 mm or more to 0.4 mm or less.

The aluminum alloy wire according to the present application may contain a plurality of aluminum alloy wires twisted together (the aluminum alloy twisted wire according to the present invention). Such a twisted wire is excellent in bendability. Further, high strength and a high impact property can be secured while the bendability is kept high. Furthermore, in the case of an extra-fine wire of 0.5 mm or less in diameter too, high strength and a high impact property can be secured. The number of twisted wires is not particularly limited, and may be 7, 11, 19, 37, 49, or 133 for example.

The aluminum alloy twisted wire according to the present application can be compressed in a radial direction (circular compression molding). As a result, it is possible to reduce gaps among aluminum alloy wires, reduce the diameter of the whole twisted wire, and contribute to the reduction of the diameter of a conductor.

Figure 1B:
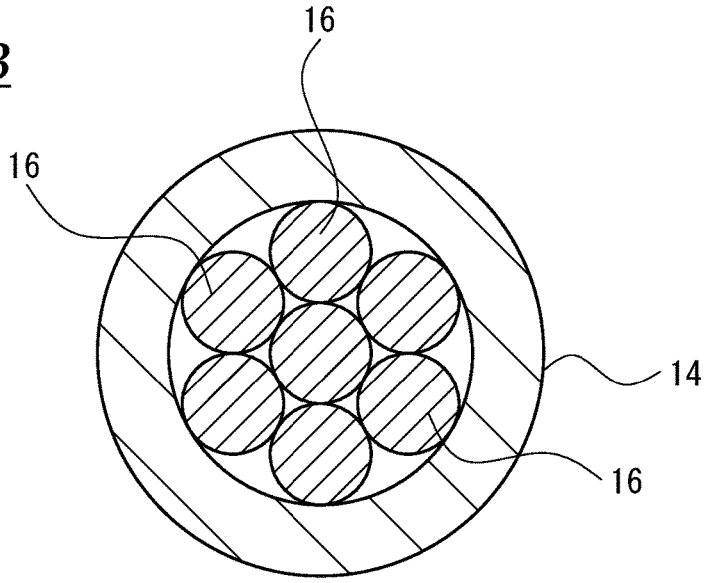
Figure 2:
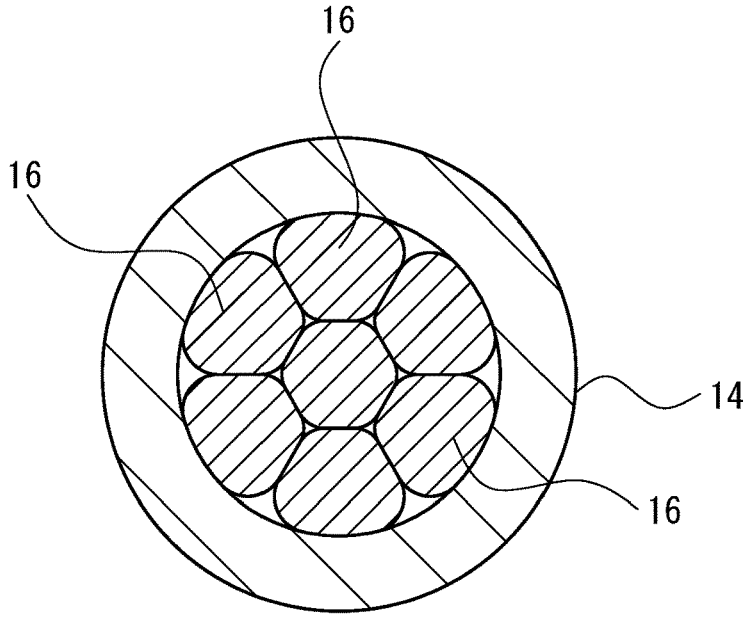
FIG. 2 is a sectional view of a covered wire formed by compression of an aluminum alloy twisted wire (conductor) shown in (b) of FIG. 1.

In FIG. 1, a perspective view (a) of an aluminum alloy twisted wire according to an embodiment of the present application and a sectional view (b) taken on line A-A in the perspective view (a) are shown. In FIG. 2, a sectional view of an aluminum alloy twisted wire compressed a conductor shown in (b) of FIG. 1 is shown.

As shown in FIG. 1, an aluminum alloy twisted wire 12 is formed by twisting a plurality of (seven in FIG. 1) aluminum alloy wires 16. As shown in FIG. 2, an aluminum alloy twisted wire 12 can be formed by compression in a radial direction (circular compression molding).

One aluminum alloy wire can configure a conductor of an electric wire. Otherwise, two or more aluminum alloy wires can configure a conductor of an electric wire. Yet otherwise, an aluminum alloy wire can configure a conductor of an electric wire by being combined with another metallic wire. The aluminum alloy twisted wire including the aluminum alloy wire can configure a conductor of an electric wire. In this way, a conductor including the aluminum alloy wire can configure the conductor of an electric wire. Then, by covering the outer circumference of a conductor including the aluminum alloy wire with an insulation coating, the covered wire is obtained.

In a covered wire according to the present application, an insulation coating is not particularly limited. Insulation materials such as a polyvinyl chloride resin (PVC) and an olefin resin can be listed. In an insulation material, a flame retardant such as a magnesium hydrate or a bromine flame retardant may be blended.

In FIG. 1, a perspective view (a) of a covered wire according to an embodiment of the present application and a sectional view (b) taken on line A-A in the perspective view (a) are shown. In FIG. 2, a sectional view of a covered wire formed by compressing a conductor shown in (b) of FIG. 1 is shown.

As shown in FIGS. 1 and 2, a covered wire 10 according to an embodiment of the present application contains a conductor containing an aluminum alloy twisted wire 12 and an insulation coating 14 covering the outer circumference of the conductor.

The wiring harness according to the present application contains the covered wire according to the present application and a terminal fitting attached to the conductor of the covered wire. A terminal fitting is attached to a terminal of the conductor. A terminal fitting is connected to the conductor by any one of various connection methods including crimping and welding. The terminal fitting is connected to a counterpart terminal fitting.

The aluminum alloy wire according to the present application includes an aluminum alloy of a heat-treatment type, which is increased in strength by precipitates precipitated by heat treatment, and can be produced from an aluminum alloy material and by a manufacturing method including at least a solution process, a wire drawing process, and an aging process.

An aluminum alloy material is obtained by casting and rolling molten alloy having a predetermined composition. A coarse metallic compound precipitates in the crystal structure of an aluminum alloy after casted. Break tends to occur from a coarse grain, and thus strength of the alloy is low.

In a solution process, solution treatment is applied to the aluminum alloy material obtained through casting and rolling. In the solution treatment, first alloy components (solid soluble elements and precipitation strengthening elements) are dissolved sufficiently by heating an aluminum alloy material to a temperature not lower than a solid solution limit temperature. Then, the aluminum alloy material is cooled and brought into an oversaturated solid solution state. The solution treatment is applied at a temperature allowing the alloy components to dissolve sufficiently. The temperature in solution treatment may be 450° C. or higher. The temperature in solution treatment is preferably 600° C. or lower and more preferably 550° C. or lower. A retention time is preferably 30 minutes or longer so as to be able to dissolve the alloy components sufficiently. Further, a retention time is preferably within 5 hours and more preferably within 3 hours from the viewpoint of productivity.

As a cooling process after a heating process in solution treatment, a rapid cooling process is preferable. By adopting rapid cooling, solid soluble elements can be inhibited from precipitating excessively. A cooling speed is preferably set so that a time elapsing while a solution treatment temperature drops to 100° C. or lower may be within 10 seconds. Such rapid cooling can be attained by forced cooling including dipping of the alloy in a liquid such as water or air cooling.

Solution treatment may be applied either in the atmosphere or in a non-oxidizing atmosphere. As a non-oxidizing atmosphere, a vacuum atmosphere (reduced-pressure atmosphere), an inert gas atmosphere such as nitrogen or argon atmosphere, a hydrogen-containing gas atmosphere, a carbon dioxide gas containing atmosphere, and the like can be used. In a non-oxidizing atmosphere, an oxide film is hardly formed over the surface of the aluminum alloy material.

Solution treatment may be applied either by continuous processing or by batch processing (non-continuous processing). In the case of continuous processing, heat treatment is likely to be applied under uniform conditions over the whole length of a long wire and hence the variations of characteristics can be reduced. A heating method is not particularly limited and any of heating such as electrical heating, induction heating, and heating using a heating furnace may be adopted. When electrical heating or induction heating is adopted as a heating method, rapid heating and rapid cooling are facilitated and hence solution treatment can be applied easily in a short period of time. When induction heating is adopted as a heating method, since the method is a non-contact method, an aluminum alloy material is prevented from being damaged.

In a wire drawing process, wire drawing is applied to the aluminum alloy material and an elemental wire is formed from a casted and rolled material. An elemental wire is a wire that can constitute an electric wire conductor and can constitute a single wire or a twisted wire. Wire drawing is applied to the aluminum alloy material that has been subjected to the solution treatment. Consequently, the wire drawing process is a process applied after a solution process. A twisted wire can be formed by twisting a desired number of obtained drawn wires. An obtained drawn wire is wound around a drum usually in the state of a single wire or a twisted wire and subjected to next treatment. When a wire drawing process is applied before a solution process, elemental wires fuse each other in the solution process and hence productivity is not satisfied.

In an aging process, aging treatment is applied to the aluminum alloy material. In the aging treatment, the alloy components (solid soluble elements and precipitation strengthening elements) in an aluminum alloy that has been subjected to solution treatment are heated and thus precipitates as compounds. The aging process therefore is a process applied after the solution process. Further, an aging process is preferably applied after the wire drawing process from the viewpoint of the easiness of wire drawing.

Aging treatment is applied at a temperature not lower than a temperature allowing the compound to precipitate and is applied under the conditions of not softening because the aging treatment is performed for precipitation strengthening. Consequently, a temperature of aging treatment is preferably in the range of 0° C. to 200° C. When a temperature of aging treatment exceeds 200° C., an aluminum alloy material tends to soften.

When the aging treatment is applied at a lower temperature for a longer period of time, precipitates are more likely to be dispersed finely and strength of the alloy is more likely to increase. When aging treatment is applied at a high temperature, precipitates are formed coarsely and unevenly, and strength of the alloy is lowered. Aging treatment therefore is applied preferably in the ranges of 0° C. to 200° C. and 1 to 100 hours. As a result, precipitates are dispersed finely and the balance between strength and electric conductivity improves. Further, from the viewpoint of productivity, aging treatment is applied more preferably in the ranges of 100° C. to 200° C. and 1 to 24 hours.

Aging treatment may be applied either in the atmosphere or in a non-oxidizing atmosphere. In a non-oxidizing atmosphere, an oxide film is hardly formed over the surface of an aluminum alloy material. Aging treatment may be applied either by continuous processing or by batch processing (non-continuous processing). In the case of continuous processing, heat treatment is likely to be applied under uniform conditions over the whole length of a long wire and hence the variations of characteristics can be reduced. A heating method is not particularly limited and any of heating such as electrical heating, induction heating, or heating using a heating furnace may be adopted. When induction heating is adopted as a heating method, since the method is a non-contact method, an aluminum alloy material is prevented from being damaged.

A softening process may be performed prior to an aging process. That is, aging treatment may be applied to the aluminum alloy material that has been subjected to softening treatment. In a softening process, softening treatment is applied to an aluminum alloy material. The softening treatment is applied in order to remove a processing strain generated by processing such as wire drawing. A softening process therefore is a process applied after the wire drawing process. Softening treatment is applied to the aluminum alloy material that has been subjected to wire drawing. Elongation that is not obtained by an ordinary tempering method for a heat treatment type aluminum alloy material can be obtained by applying the softening treatment and, as a result, bendability, processability to a wiring harness (improvement of flexibility), and impact resistance properties are obtained as electric wire characteristics.

Softening treatment is applied at a temperature not lower than a temperature necessary for softening. A temperature of softening treatment therefore is preferably 250° C. or higher and more preferably 300° C. or higher. When a temperature of softening treatment is lower than 250° C., an aluminum alloy material softens insufficiently. From the viewpoint of productivity in contrast, a temperature of softening treatment is preferably 600° C. or lower and more preferably 550° C. or lower.

Softening treatment is applied in a short period of time not exceeding 10 seconds. A temperature of softening treatment is a temperature that allows aging precipitation to occur and coarse precipitates to be generated. Thus, when the time spent for the softening treatment of a heat treatment type aluminum alloy material that has been subjected to solution treatment increases, strength lowers by the aging precipitation. For the reason, softening treatment has to be applied in a very short period of time so as not to generate coarse precipitates (so as not to cause aging precipitation). And from this viewpoint, softening treatment is applied preferably in a short period of time not exceeding 5 seconds.

Softening treatment, when it is applied by a batch heating method, requires a long heating time and hence is hardly finished in a short period of time. As a result, aging precipitation proceeds simultaneously with softening. Softening treatment therefore is performed preferably by a continuous heating method. Further, when a continuous heating method is adopted, heat treatment is likely to be applied under uniform conditions over the whole length of a long wire and hence variations of characteristics can be reduced. As a continuous heating method, an electrical heating method, an induction heating method, a furnace heating method, and the like are named. When an electrical heating method or an induction heating method is adopted, rapid heating and rapid cooling are facilitated and hence solution treatment is likely to be applied in a short period of time. When an induction heating method is adopted, since the method is a non-contact method, an aluminum alloy material is prevented from being damaged.

As a cooling process after a heating process in softening treatment, a rapid cooling process is preferable. By adopting rapid cooling, a solid solution element can be inhibited from precipitating excessively. A cooling speed is set preferably so that a time elapsing while a solution treatment temperature drops to 100° C. or lower may be within 10 seconds. Such rapid cooling can be attained by forced cooling including dipping in a liquid such as water or air cooling.

Softening treatment may be applied either in the atmosphere or in a non-oxidizing atmosphere. As a non-oxidizing atmosphere, a vacuum atmosphere (reduced-pressure atmosphere), an inert gas atmosphere such as nitrogen or argon atmosphere, a hydrogen containing gas atmosphere, a carbon dioxide gas containing atmosphere, and the like can be used. In a non-oxidizing atmosphere, an oxide film is hardly formed over the surface of the aluminum alloy material.

According to an above-shown manufacturing method of an aluminum alloy wire, an aluminum electric wire that not only is excellent in elongation but also satisfies productivity while keeping high strength and high electric conductivity is obtained even in the case of a small diameter wire. A heat treatment type aluminum alloy material can exhibit excellent strength by precipitation strengthening of a metallic compound, and hence can increase strength while inhibiting electric conductivity from lowering caused by an additive element. That is, the aluminum alloy material can secure both strength and electric conductivity. Further, since softening treatment is applied, excellent elongation can also be secured. Since softening treatment is applied in a short period of time not exceeding 10 seconds, a coarse metallic compound is inhibited from precipitating in the softening treatment, and strength is inhibited from lowering. That is, strength is inhibited from lowering while a strain caused by wire drawing is removed. Further, since wire drawing is applied after solution treatment, elemental wires hardly fuse each other and productivity is also satisfied. Since wire drawing is applied after solution treatment, softening treatment is applied as heat treatment for removing a processing strain after wire drawing, which is distinguished from solution treatment.

EXAMPLES

Examples according to the present application are explained hereunder.

Casting and rolling are applied to molten alloy having the alloy compositions described in Table 1 and aluminum alloy materials were obtained as wire rods of 9.5 mm in diameter. By using the obtained aluminum alloy materials, aluminum alloy wires of predetermined wire diameters were manufactured through solution treatment, wire drawing, softening treatment, and aging treatment.

Example 1

An aluminum alloy twisted wire having a configuration as shown in FIG. 1 was manufactured by bundling and twisting 19 aluminum alloy wires of 0.155 mm in diameter at a twist pitch of 16 mm to form a twisted wire without applying circular compression. A covered wire was manufactured by covering the obtained aluminum alloy twisted wire with a vinyl chloride resin of 0.2 mm in thickness by extrusion coating. A wiring harness was manufactured by crimping a terminal fitting to the conductor of the obtained covered wire.

Examples 2 to 7, Comparative Examples 1 and 2

Aluminum alloy twisted wires were manufactured with the conditions of the wire diameters, the numbers of wires, and the twist pitches described in Table 1 similarly to Example 1. In Examples 3, 6, and 7, circular compression molding was applied and aluminum alloy twisted wires having a configuration as shown in FIG. 2 were manufactured. Further, covered wires and wiring harnesses were manufactured similarly to Example 1.

For each of the obtained aluminum alloy wires, tensile strength, elongation, electric conductivity, a dislocation density, the number of $Mg_2Si$ precipitates, the aspect ratio of an $Mg_2Si$ precipitate, and the long axis and short axis of an $Mg_2Si$ precipitate were measured. Further, for each of the obtained wiring harness, impact resistance at a crimped part was evaluated.

(Tensile Strength and Elongation)

Tensile strength and elongation were measured with a general-purpose tensile tester in accordance with JIS Z2241 (Method of Tensile Test for Metallic Materials, 1998).

(Electric Conductivity)

Electric conductivity was measured by a bridge method.

(Dislocation Density)

A metal thin film of 0.15 μm in thickness was formed from an obtained aluminum alloy wire by an FIB method, the metallic thin film was observed with a transmission electron microscope (TEM), and an area of 700 nm×850 nm where a largest number of dislocations are recognized was photographed. Then parallel lines were drawn vertically and horizontally respectively over the photograph, and a dislocation density ρ was calculated through the formula ρ=2N/(L×t), where the total length of the parallel lines was represented by L, the number of the intersections formed between the parallel lines and dislocations was represented by N, the thickness of a specimen was represented by t.

(Amount of $Mg_2Si$ Precipitates)

A cross section in a radial direction of an obtained aluminum alloy wire was observed with a transmission electron microscope (TEM). A region of 700 nm×850 nm was photographed, and the number of the precipitates having the long axes of 5 to 50 nm in an acicular $Mg_2Si$ precipitate was measured in each of the 12 areas of 350 nm×425 nm. The average of the measured numbers in the 12 areas was calculated as the amount of the $Mg_2Si$ precipitates.

(Aspect Ratio, Long Axis, and Short Axis of $Mg_2Si$ Precipitate)

A region of 700 nm×850 nm on a cross section in a radial direction of an obtained aluminum alloy wire was photographed with a transmission electron microscope (TEM), the long axes, the short axes, and the aspect ratios of 40 pieces of the precipitates having the long axes of 5 to 50 nm in an acicular $Mg_2Si$ precipitate were measured in each of the 12 areas of 350 nm×425 nm, and the averages of the measured values of the 40 precipitates and the 12 areas were calculated as the aspect ratio, the long axis, and the short axis of the $Mg_2Si$ precipitate.

(Impact Resistance)

Figure 3:
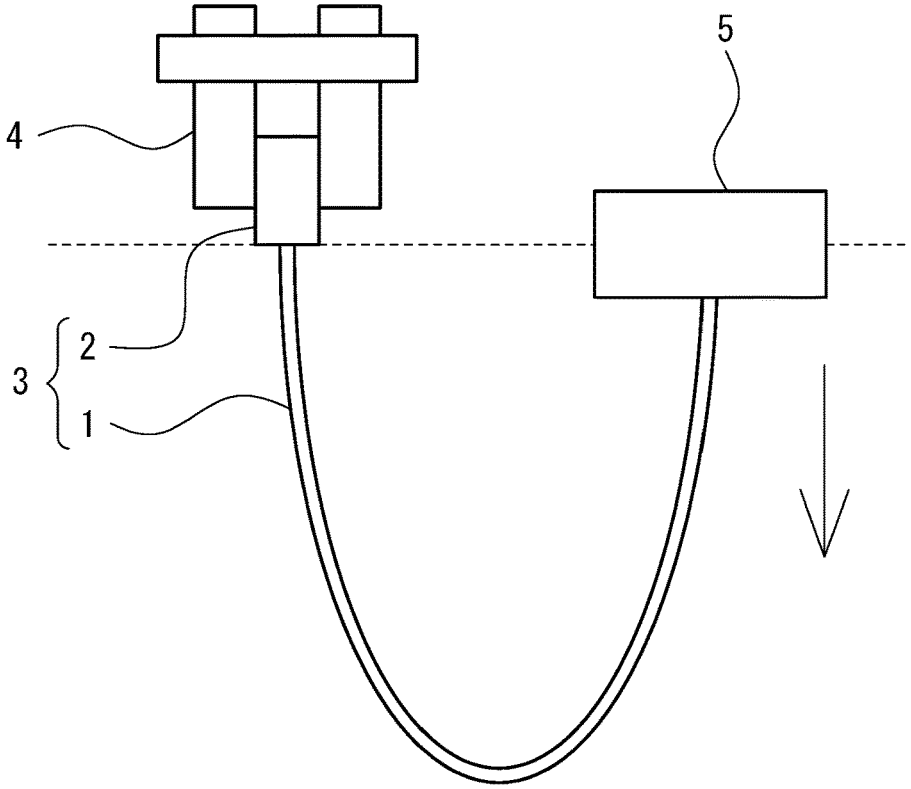
FIG. 3 is a schematic diagram of a test method for measuring impact strength when a terminal fitting is connected.

As shown in FIG. 3, a terminal fitting 2 of a wiring harness 3 formed by crimping the terminal fitting 2 to an end of a conductor (aluminum alloy twisted wire) of a covered wire 1 of 500 mm in length was fixed with a jig 4, a weight 5 attached to the other end of the wiring harness 3 was pulled up to the height where the terminal fitting 2 was fixed, and the weight 5 fell freely. A maximum load (g) at which a conductor (aluminum alloy twisted wire) of a covered wire 1 did not break at a crimped part in the drop test was regarded as an index of impact resistance. A case where a maximum load was 100 g or more was regarded as excellent in impact resistance and a case where a maximum load was 300 g or more was regarded as particularly excellent in impact resistance.

TABLE 1

| | Component (mass %) | | | | | | | Process | | |
|---|---|---|---|---|---|---|---|---|---|---|
| | Mg | Si | Fe | Zr | Ti | B | Al | Solution | Continuous softening | Aging treatment |
| Example 1 | 0.56 | 0.43 | 0.18 | 0.04 | 0.01 | 0.005 | Balance | 530° C. | 500° C. × within 1 sec | 150° C. × 10 h |
| Example 2 | 0.56 | 0.43 | 0.18 | 0.04 | 0.01 | 0.005 | Balance | 530° C. | 500° C. × within 1 sec | 150° C. × 10 h |
| Example 3 | 0.56 | 0.43 | 0.18 | 0.04 | 0.01 | 0.005 | Balance | 530° C. | 500° C. × within 1 sec | 160° C. × 10 h |
| Example 4 | 0.62 | 0.50 | 0.20 | 0.05 | 0.01 | 0.005 | Balance | 530° C. | 500° C. × within 1 sec | 150° C. × 10 h |
| Example 5 | 0.62 | 0.50 | 0.20 | 0.05 | 0.01 | 0.005 | Balance | 530° C. | 500° C. × within 1 sec | 150° C. × 10 h |
| Example 6 | 0.62 | 0.50 | 0.20 | 0.05 | 0.01 | 0.005 | Balance | 530° C. | 500° C. × within 1 sec | 140° C. × 10 h |
| Example 7 | 0.66 | 0.57 | 0.22 | 0.00 | 0.00 | 0.000 | Balance | 530° C. | 500° C. × within 1 sec | 150° C. × 10 h |
| Comparative Example 1 | 0.56 | 0.43 | 0.18 | 0.04 | 0.01 | 0.005 | Balance | 530° C. | 500° C. × within 1 sec | 250° C. × 3 h |
| Comparative Example 2 | 0.62 | 0.50 | 0.20 | 0.05 | 0.01 | 0.005 | Balance | 530° C. | 350° C. × within 1 sec | 150° C. × 10 h |

| | Structure | | |
|---|---|---|---|
| | Twist pitch (mm) | Number/wire diameter (mm) | Molding |
| Example 1 | 16.0 | 19/0.155 | Uncompressed |
| Example 2 | 20.5 | 7/0.3 | Uncompressed |
| Example 3 | 23.8 | 7/0.32 | Compressed |
| Example 4 | 16.0 | 19/0.155 | Uncompressed |
| Example 5 | 20.5 | 7/0.3 | Uncompressed |
| Example 6 | 23.8 | 7/0.32 | Compressed |
| Example 7 | 23.8 | 7/0.32 | Compressed |
| Comparative Example 1 | 16.0 | 19/0.155 | Uncompressed |
| Comparative Example 2 | 16.0 | 19/0.155 | Uncompressed |

TABLE 2

| | | $Mg_2Si$ precipitates (5~50 nm) | | | | | | | |
|---|---|---|---|---|---|---|---|---|---|
| | Dislocation Density ($cm^{-2}$) | Number of pieces | Aspect ratio | Long axis (nm) | Short axis (nm) | Tensile strength (MPa) | Elongation (%) | Electric conductivity % IACS | Impact resistance (g) |
| Example 1 | $7 \times 10^8$ | 206 | 2.6 | 13 | 5 | 230 | 13 | 51 | 150 |
| Example 2 | $3 \times 10^8$ | 188 | 3.0 | 15 | 5 | 256 | 12 | 52 | 250 |
| Example 3 | $9 \times 10^7$ | 245 | 4.0 | 10 | 2.5 | 245 | 13 | 52 | 650 |
| Example 4 | $5 \times 10^8$ | 412 | 4.0 | 25 | 6.3 | 270 | 11 | 51 | 200 |
| Example 5 | $1 \times 10^8$ | 288 | 4.2 | 30 | 7.1 | 275 | 11 | 50 | 300 |
| Example 6 | $8 \times 10^7$ | 328 | 5.1 | 32 | 6.3 | 280 | 10 | 51 | 700 |
| Example 7 | $5 \times 10^6$ | 566 | 5.6 | 22 | 3.9 | 248 | 10 | 50 | 500 |

TABLE 2-continued

| | Dislocation Density ($cm^{-2}$) | $Mg_2Si$ precipitates (5~50 nm) Number of pieces | Aspect ratio | Long axis (nm) | Short axis (nm) | Tensile strength (MPa) | Elongation (%) | Electric conductivity % IACS | Impact resistance (g) |
|---|---|---|---|---|---|---|---|---|---|
| Comparative Example 1 | $2 \times 10^6$ | 400 | 1.9 | 25 | 13 | 140 | 12 | 52 | 50 |
| Comparative Example 2 | $>10^{10}$ | 300 | 7.0 | 30 | 4.3 | 248 | 5 | 51 | 80 |

In the aluminum alloy wires of Examples 1 to 7, the $Mg_2Si$ precipitates are acicular, the aspect ratios are in the specific range, and hence they are excellent in impact resistance. In the aluminum alloy wires of Comparative Examples 1 and 2 in contrast, although the $Mg_2Si$ precipitates are acicular, the aspect ratios deviate from the specific range and hence they are poor in impact resistance.

Although the embodiments according to the present invention have heretofore been explained in detail, the present invention is not limited at all to the embodiments and can be modified variously within the range not departing from the tenor of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An aluminum alloy wire comprising:

0.03% or more and 1.5% or less by mass of Mg;

0.02% or more and 2.0% or less by mass of Si;

0.1% or more and 0.3% or less by mass of Fe; and 0.01% or more and 0.05% or less by mass Zr, with the balance consisting of Al and impurities, the wire comprising acicular-shaped $Mg_2Si$ precipitates of 2.0 to 6.0 in aspect ratio and lengths less than 40 nm, and having an elongation of 5% or higher, and wherein a number of the $Mg_2Si$ precipitates having grain diameters of 5 to 50 nm is 100 or more in an area of 350 nm×425 nm on a cross section in a radial direction of the wire.

2. The aluminum alloy wire according to claim 1, further comprising 0.016% or less by mass of B.

3. The aluminum alloy wire according to claim 1, further comprising 0.08% or less by mass of Ti.

4. The aluminum alloy wire according to claim 3, further comprising 0.016% or less by mass of B.

5. The aluminum alloy wire according to claim 1, wherein the aluminum alloy wire has a dislocation density of $5.0 \times 10^9$ $cm^{-2}$ or less.

6. The aluminum alloy wire according to claim 1, wherein the $Mg_2Si$ precipitates are oriented in an axial direction of the wire.

7. The aluminum alloy wire according to claim 1, wherein the aluminum alloy wire has a tensile strength of 150 MPa or higher.

8. The aluminum alloy wire according to claim 1, wherein the aluminum alloy wire has an electric conductivity of 40% IACS or higher.

9. The aluminum alloy wire according to claim 1, wherein the aluminum alloy wire has a diameter of 0.5 mm or less.

10. The aluminum alloy wire according to claim 1, wherein the aluminum alloy wire has an impact resistance of 150 g or more, where the impact resistance is defined as a maximum load at which a sample comprising a conductor consisting of 19 pieces of the aluminum alloy wire of a diameter of 0.155 mm bundled and twisted together at a twist pitch of 16 mm and a terminal fitting crimped to an end of the conductor at a crimping part does not break at the crimping part when the load attached to the other end of the conductor is pulled up to the height where the terminal fitting is fixed, and falls freely.

11. The aluminum alloy wire according to claim 1, wherein the number of $Mg_2Si$ precipitates exceeding 50 nm in grain diameter is 50 or less in an area of 16 μm×6.8 μm on a cross section in a radial direction of the wire.

12. An aluminum alloy twisted wire comprising a plurality of the aluminum alloy wires according to claim 1, twisted together.

13. The aluminum alloy twisted wire according to claim 12, compressed in a radial direction.

14. A covered wire comprising:

a conductor comprising the aluminum alloy wire according to claim 1; and an insulation coating covering the outer circumference of the conductor.

15. A wiring harness comprising:

the covered wire according to claim 14; and a terminal fitting attached to the conductor of the covered wire.

16. The aluminum alloy twisted wire according to claim 1, wherein the aspect ratio of the acicular-shaped $Mg_2Si$ precipitates is from 4.0 to 6.0.

* * * * *